US007993144B2

(12) United States Patent
Hu et al.

(10) Patent No.: US 7,993,144 B2
(45) Date of Patent: Aug. 9, 2011

(54) RECEPTACLE RF CONNECTOR HAVING CUTOUTS ON A TUBULAR FRAME OF AN OUTER SHELL

(75) Inventors: Lan-Ping Hu, Shenzhen (CN); Wei-Jie Huo, Shenzhen (CN); Yong-Hui Hu, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 60 days.

(21) Appl. No.: 12/626,953

(22) Filed: Nov. 30, 2009

(65) Prior Publication Data

US 2010/0136828 A1 Jun. 3, 2010

(30) Foreign Application Priority Data

Nov. 28, 2008 (CN) ..... 2008 1 0305839

(51) Int. Cl.
*H01R 12/00* (2006.01)

(52) U.S. Cl. ..... 439/63

(58) Field of Classification Search ..... 439/63, 439/578, 581, 582
See application file for complete search history.

(56) References Cited

U.S. PATENT DOCUMENTS

| | | | | |
|---|---|---|---|---|
| 6,474,995 | B1 * | 11/2002 | Wu | 439/63 |
| 7,118,383 | B2 * | 10/2006 | Nagata et al. | 439/63 |
| 7,331,805 | B1 * | 2/2008 | Hu | 439/188 |
| 7,564,003 | B2 * | 7/2009 | Hu et al. | 200/406 |
| 7,651,335 | B2 * | 1/2010 | Chen | 439/63 |
| 2008/0237020 | A1 * | 10/2008 | Hu et al. | 200/516 |
| 2009/0247008 | A1 * | 10/2009 | Chen | 439/578 |

* cited by examiner

*Primary Examiner* — Chandrika Prasad
(74) *Attorney, Agent, or Firm* — Wei Te Chung; Andrew C. Cheng; Ming Chieh Chang

(57) ABSTRACT

A receptacle RF connector includes an outer shell having a third unsealed tubular frame, at least a cutout is defined around the third unsealed tubular frame and runs through a lower periphery downwardly, each cutout has an upper periphery and is located under a locking tuber correspondingly, the upper periphery of each cutout keeps a predetermined distance with a top face of the dielectric block, so as to avoid the overloaded stress loaded on the receptacle RF connector caused by the plug RF connector.

18 Claims, 6 Drawing Sheets

RECEPTACLE RF CONNECTOR HAVING CUTOUTS ON A TUBULAR FRAME OF AN OUTER SHELL

BACKGROUND OF THE INVENTION

1. Field of the Invention

The present invention relates to an RF connector, and more particularly to a RF connector which is provided with at least a cutout on a tubular frame of an outer shell.

2. Description of the Related Art

US Patent Publication No. 2009/0247008 published on Oct. 1, 2009, discloses a receptacle RF connector 100 for mating with a plug RF connector 200, the receptacle RF connector 100 includes an inner conductor 2 having a base 21 with a first unsealed tubular section 20 defined thereof. A dielectric block 1 having a second tubular section 16 protrudes from the upper surface of the dielectric block 1 and disposed outside of the first tubular section 20 of the conductor. An outer shell 3 has a third unsealed tubular frame 31. The third tubular frame 31 is spaced from the second tubular section 16 with a predetermined distance for mating with the plug connector 200. The outer shell 3 also includes a locking groove 310 on an inner ring of the third unsealed tubular frame 31.

The plug connector 200 having a second outer shell 4, the second outer shell 4 has a plurality of tubers defined on the outer face, the tubers abut against with the locking groove 310 of the third tubular frame 31 after the assembling. Meanwhile, the third tubular frame 31 is integrally molded with the dielectric block 1. Because the bottom of the third tubular frame 31 is held by the dielectric block 1, the elastic force between the tubers and the locking groove 310 decreases after inserting the second outer shell 4 into the third tubular frame 31 more than one time, and also the tubers of the outer shell 3 could be scratched easily because of the stiff force between the tubers and the locking groove 310.

Therefore, there is a need to provide a receptacle RF connector to resolve the above-mentioned problem.

SUMMARY OF THE INVENTION

A receptacle RF connector made according to an embodiment of the present invention includes an inner conductor having a base with opposite first and second sides, and opposite third and fourth sides; a dielectric block assembled with the conductor, the block has a second tubular section disposed outside of the first tubular section of the conductor; an outer shell integrally molded with the dielectric block as a unit, the outer shell has a third unsealed tubular frame with a plurality of locking tubers defined on an inner ring thereof, the third tubular frame is spaced from the second tubular section in a radial direction with a predetermined distance; the outer shell has a lower periphery; wherein at least a cutout is defined around the third unsealed tubular frame and runs through the lower periphery downwardly, each cutout has an upper periphery and is located under a locking tuber correspondingly, the upper periphery of each cutout keeps a predetermined distance with a top face of the dielectric block. Thus, the third unsealed tubular frame is not held by the dielectric block completely, and in order to ease the stress concentrated thereon when assembling the plug RF connector onto the receptacle RF connector.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
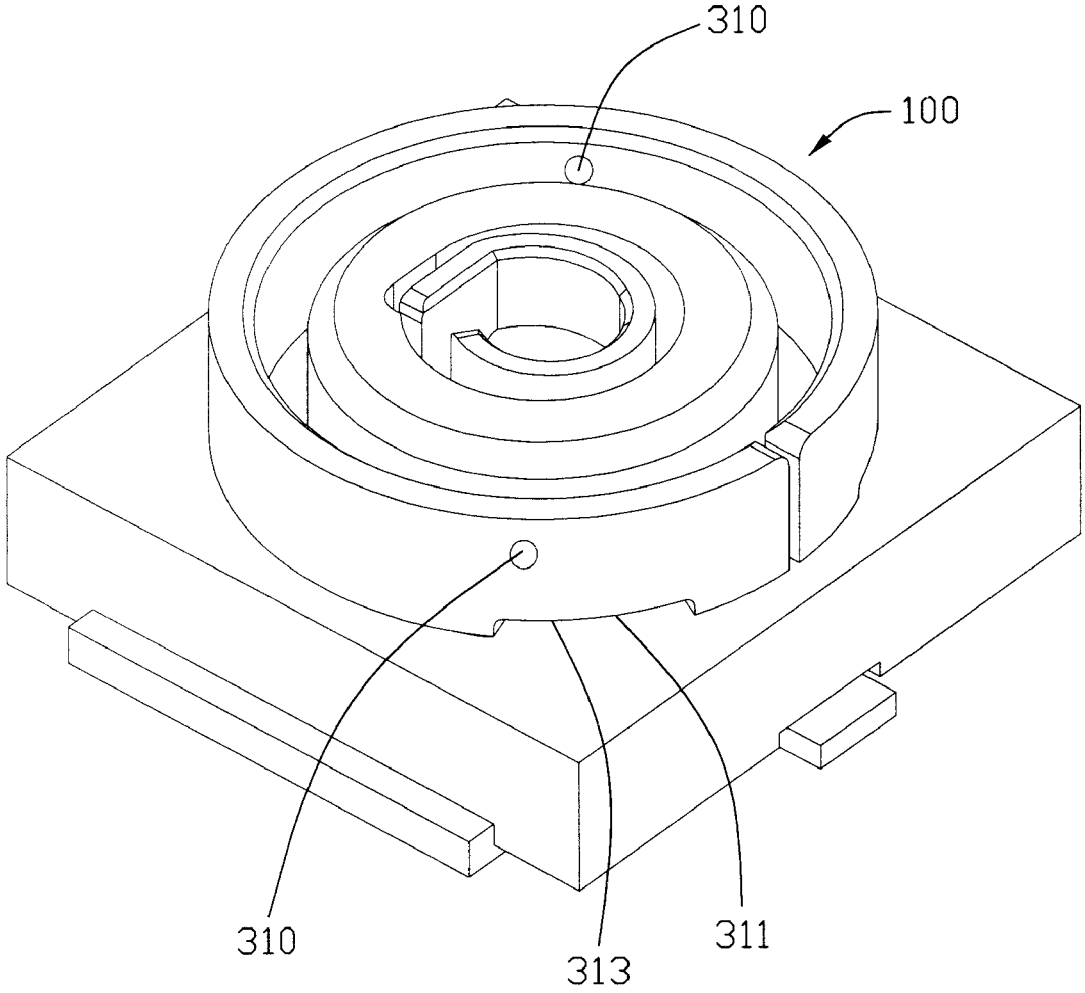
FIG. 1 is a perspective view of a receptacle RF connector according to an embodiment of the present invention.
Figure 2:
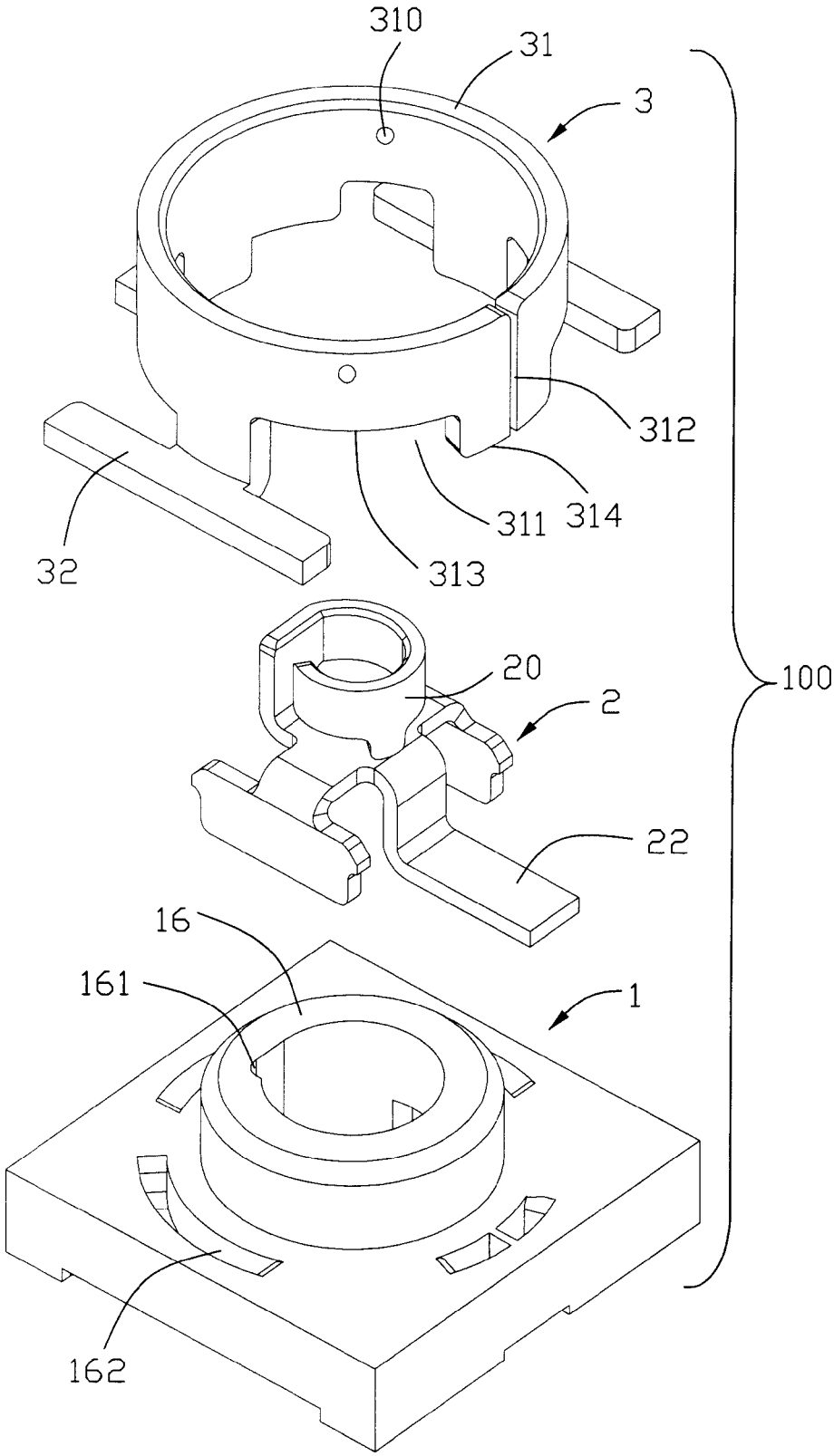
FIG. 2 is an explored, perspective view of the receptacle RF connector shown in FIG. 1.
Figure 3:
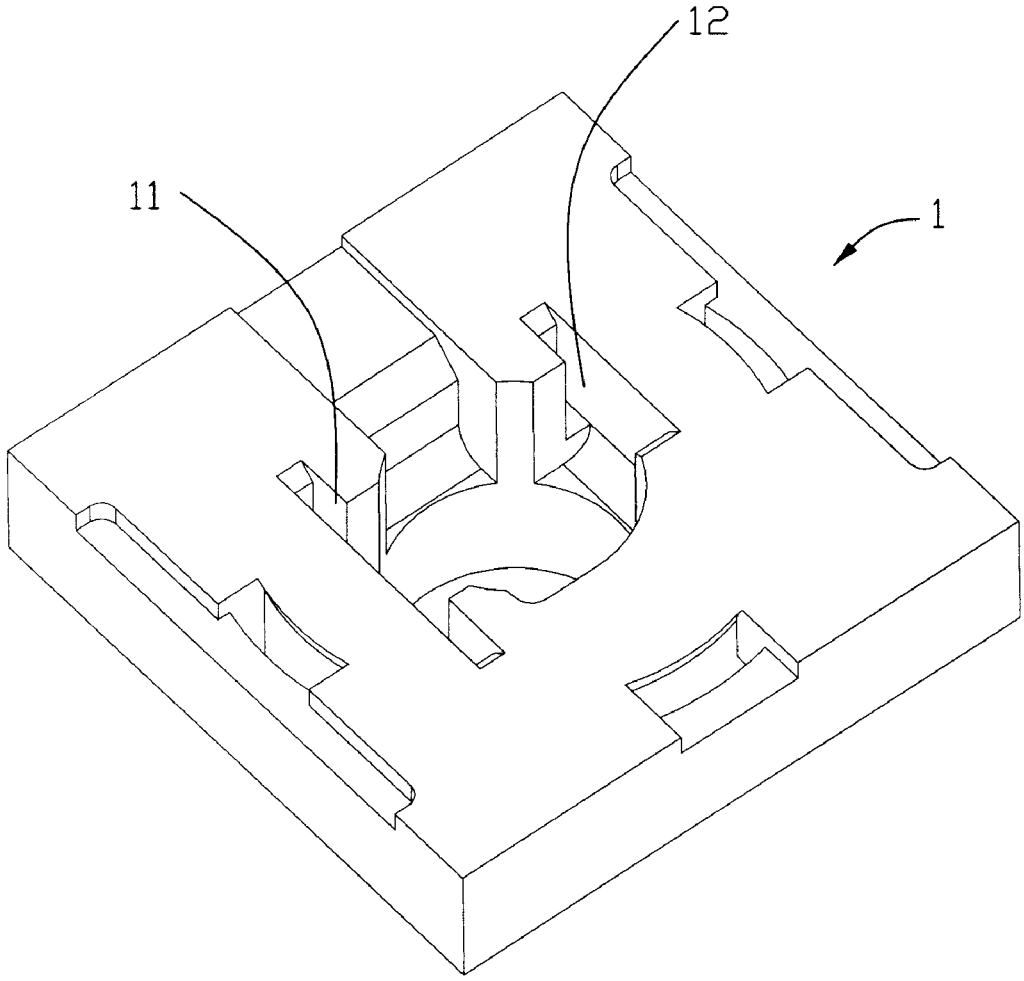
FIG. 3 is a perspective view of a dielectric block of the receptacle RF connector, view from a bottom of the dielectric block.
Figure 4:
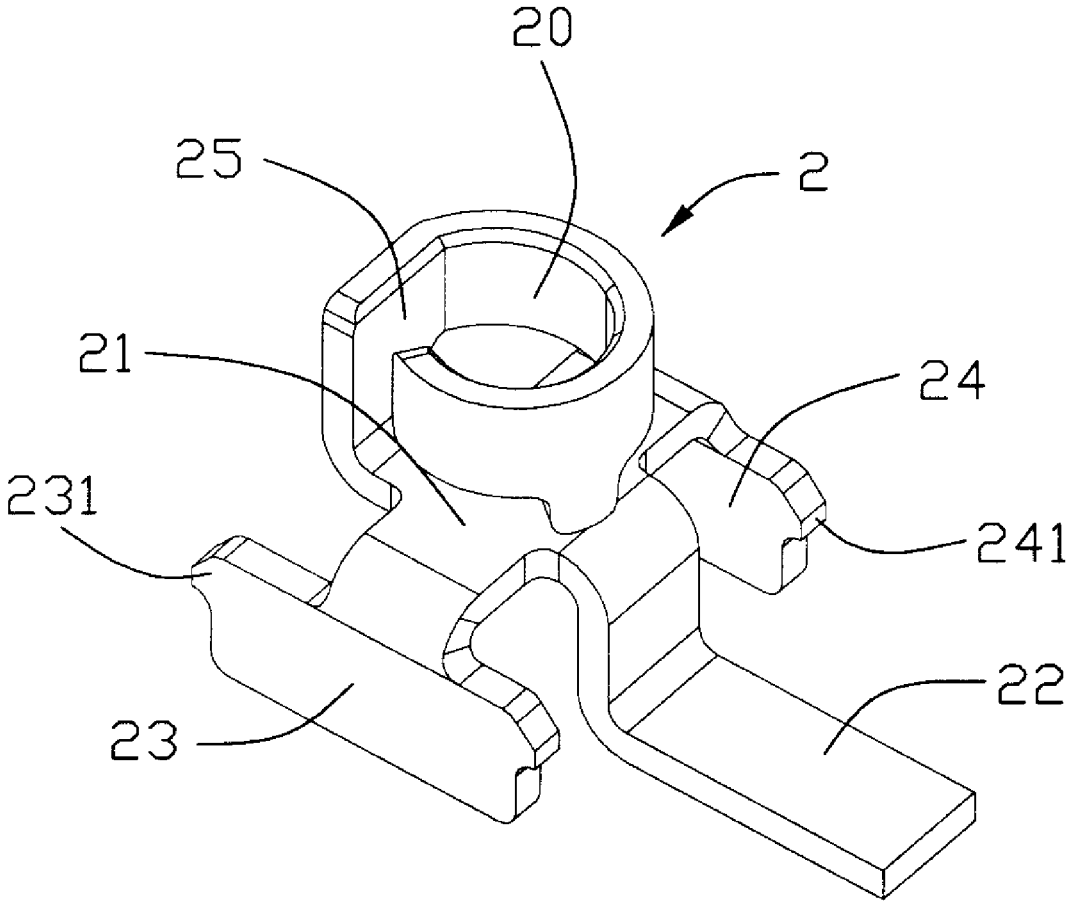
FIG. 4 is a perspective view of an inner conductor of the receptacle RF connector shown in FIG. 2.
Figure 5:
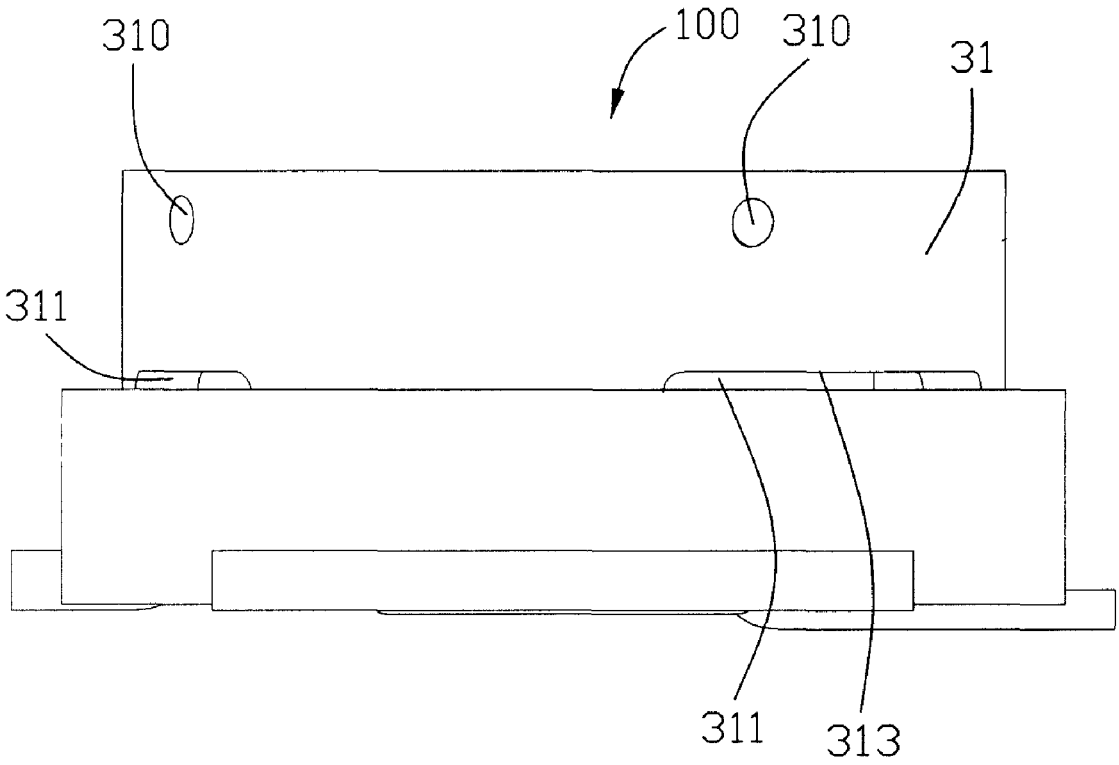
FIG. 5 is a side elevation drawing of the receptacle RF connector shown in FIG. 2.

Referring to FIGS. 1, 2 and 5, a receptacle RF connector 100 according to an embodiment of the present invention is shown to mate with a plug connector (not shown). The receptacle RF connector 100 includes an inner conductor 2, a dielectric block 1 assembled with the conductor 2, and an outer shell 3 integrally molded with the dielectric block 1 as a unit.

The inner conductor 2 includes a base 21 with opposite first and second sides, and opposite third and fourth sides thereof, a first unsealed tubular section 20 having a portion attached to the first side, a pair of retention walls 23 and 24 respectively attached to the third and fourth sides, and a solder leg formed of a zigzag shape and disposed on the second side with a solder tail 22 for surface mounted onto a first printed circuit board (not shown). The first unsealed tubular section 20 is formed by curling around an axial direction orthogonal to the base 21, and having its initial axial edge parallel to the axial direction, a parallel terminating axial edge adjacent to a side wall 25, which extends directly and upwardly from the first side of the base 21 of the conductor 2, and a periphery bottom edge are both vertical to the initial axial edge and the terminating axial edge. The periphery bottom edge is spaced from and above the base 21 of the conductor 2 with a certain distance. The initial axial edge of the first unsealed tubular section 20 is connected to a corresponding vertical side edge of the side wall 25.

The pair of retention walls 23 and 24 is disposed in an opposite relationship with respect to the solder tail 22 and vertical to the base 21 of the conductor 2, with one retention wall 23 having a T-shaped configuration and the other 24 having an L-shaped configuration. The retention wall 23, 24 has a retention rib 231, 241 on at least one side edge of the retention wall 23, 24. The retention walls 23, 24 are configured to extend into a body of the dielectric block 1. The dielectric block 1 of the receptacle RF connector 100 has retention slots 11, 12 for the respective retention walls 23, 24 to be interferentially engaged therewith. Thus, the conductor 2 is securely held within the dielectric block 1 by the engagement of the retention walls 23, 24 and the retention slots 11, 12 so as to avoid the unstable assembly of the conductor 2 and the dielectric block 1 of the prior art merely by means of the zigzag solder leg.

The dielectric block 1 has a second tubular section 16 disposed outside of the first tubular section 20 of the conductor 2 with an axial recess 161 on an inner surface of the second tubular section 16. A plurality of receiving slots 162 runs through the first tubular section 20 from top down. Each receiving slot 162 is curved corresponding to the periphery of the outer shell 3.

The outer shell 3 has a third unsealed tubular frame 31 with an axial slit 312 also along the axial direction of the first unsealed tubular section 20, and three solder pads 32 located around the bottom periphery of the tubular frame 31. Those three solder pads 32 are at a same level with the solder tail 22 of the conductor 2. The third tubular frame 31 is spaced from the second tubular section 16 in a radial direction with a predetermined distance for mating with the plug connector. The outer shell 3 also includes four locking tubers 310 on an inner ring of the third unsealed tubular frame 31 of the shell 3.

A plurality of cutouts 311 is defined around the third unsealed tubular frame 31 of the outer shell 3. Each cutout 311 is defined under a corresponding locking tuber 310 and runs through the lower periphery 314 thereof. When the outer shell 3 is molded with the dielectric block 1 as a unit, the third tubular frame 31 is partly embedded in the dielectric block 1. The upper periphery 313 of each cutout 311 keeps a predetermined distance with a top face of the dielectric block 1. So that the third unsealed tubular frame 31 is not held by the dielectric block 1 completely, and in order to release the stress loaded thereon by the plug RF connector when assembling the plug RF connector onto the receptacle RF connector 100.

Figure 6:
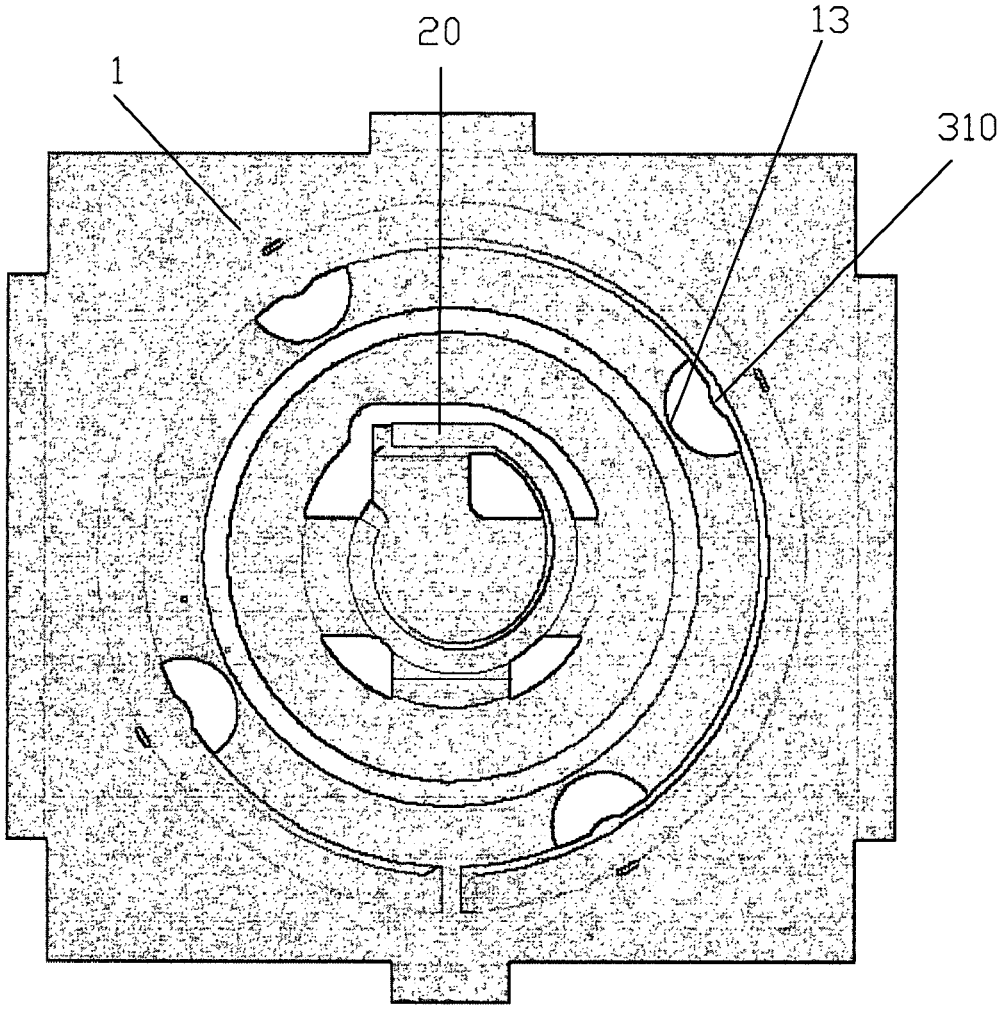
FIG. 6 is a top view of the connector according to another embodiment of the invention.

FIG. 6 shows another embodiment of the invention wherein the housing 1 may further include optionally a plurality of through holes or recesses 13 right below the corresponding locking tubers 310 so as to relieve the corresponding areas of the outer shell 3 around/under the locking tubers 310, respectively.

While the present invention has been described with reference to preferred embodiments, the description of the invention is illustrative and is not to be construed as limiting the invention. Various modifications to the present invention can be made to preferred embodiments by those skilled in the art without departing from the true spirit and scope of the invention as defined by the appended claims.

What is claimed is:

1. A receptacle RF connector, comprising:

an inner conductor including a base with opposite first and second sides, and opposite third and fourth sides;

a dielectric block assembled with the conductor, the block having a second tubular section disposed outside of the first tubular section of the conductor;

an outer shell integrally molded with the dielectric block as a unit, the outer shell having a third unsealed tubular frame with a plurality of locking tubers defined on an inner ring thereof, the third tubular frame being spaced from the second tubular section in a radial direction with a predetermined distance; the outer shell having a lower periphery;

wherein at least a cutout is defined around the third unsealed tubular frame and runs through the lower periphery downwardly, each cutout has an upper periphery and is located under a locking tuber correspondingly, the upper periphery of each cutout keeps a predetermined distance with a top face of the dielectric block.

2. The receptacle RF connector of claim 1, wherein the cutouts are spaced from each other along the outer ring of the third unsealed tubular frame.

3. The receptacle RF connector of claim 1, wherein a solder leg disposed on said second side with a solder tail, retention walls respectively attached to said third and fourth sides and are configured to extend into a body of the dielectric block.

4. The receptacle RF connector of claim 1, wherein three solder pads being at a same level with said solder tail of the conductor.

5. The receptacle RF connector of claim 1, wherein the dielectric block has retention slots for the retention walls to be interferentially engaged therewith.

6. The receptacle RF connector of claim 3, wherein each of the retention walls is essentially arranged vertical to the base of the conductor.

7. The receptacle RF connector of claim 6, wherein the retention wall has a retention rib on at least one side edge of the retention wall.

8. The receptacle RF connector of claim 1, wherein an axial slit is defined along said axial direction on third unsealed tubular frame.

9. The receptacle RF connector of claim 1, wherein receiving slots are defined through the dielectric block, each receiving slot is curved corresponding to the periphery of the outer shell.

10. An electrical connector comprising:

an insulative housing defining a base section with a tubular portion upward extending therefrom;

an inner metallic conductor defining a base from which, a tubular section upwardly extends, a retention section and a soldering tail downwardly extend, under condition that the tubular section is concentrically located within the tubular portion, the retention section is embedded in the housing and the soldering tail is exposed outside of the housing; and an outer metallic conductor defining a tubular frame concentrically surrounding the tubular portion with a plurality of solder pads exposed under the housing and with a plurality of locking tubers formed in an interior face of said tubular frame around an upper rim thereof for interengagement with an inserted plug; wherein a plurality of recesses are formed at least in one of said housing and said outer conductor under condition that each of said recesses is essentially vacant and located right under the corresponding locking tuber in a vertical direction so as to relieve corresponding area of the outer conductor around an underside of the corresponding locking tuber.

11. The electrical connector as claimed in claim 10, wherein each of said recesses is a notch formed in the outer conductor under the corresponding locking tuber.

12. The electrical connector as claimed in claim 10, wherein each of said recesses is a through hole formed in the housing under the corresponding locking tuber.

13. The electrical connector as claimed in claim 10, wherein said outer conductor is integrally molded within the housing at four positions with 90 degrees intervals thereof.

14. The electrical connector as claimed in claim 10, wherein said inner conductor is integrally formed molded within the housing at three positions with 90 degrees intervals thereof.

15. The electrical connector as claimed in claim 10, wherein each of said recesses is a notch formed in the outer conductor under the corresponding locking tuber under condition that an upper periphery of said notch is higher than an upper face of the housing.

16. An electrical connector comprising:

an insulative housing defining a base section with a tubular portion upward extending therefrom;

an inner metallic conductor defining a base from which, a tubular section upwardly extends, and a soldering tail downwardly extend, under condition that the tubular section is concentrically located within the tubular portion and the soldering tail is exposed outside of the housing; and an outer metallic conductor defining a tubular frame concentrically surrounding the tubular portion with a plurality of solder pads exposed under the housing and with a plurality of locking tubers formed in an interior face of said tubular frame around an upper rim thereof for interengagement with an inserted plug; wherein a plurality of recesses are formed in said outer conductor under condition that each of said recesses is essentially vacant and located right under the corresponding locking tuber in a vertical direction so as to relieve corresponding area of the outer conductor around an underside of the corresponding locking tuber.

17. The electrical connector as claimed in claim 16, wherein an upper periphery of each of said recesses is higher than an upper face of the housing.

18. The electrical connector as claimed in claim 16, wherein said recesses are located around four corners of the housing.

* * * * *